US006470896B1

(12) United States Patent
Mensonides

(10) Patent No.: US 6,470,896 B1
(45) Date of Patent: Oct. 29, 2002

(54) HAIR BAND HAVING STRAPS AND FLEXIBLE ROD

(76) Inventor: Nicole L. Mensonides, 4737 81st. Place SW., Mukilteo, WA (US) 98275

( * ) Notice: Subject to any disclaimer, the term of this patent is extended or adjusted under 35 U.S.C. 154(b) by 0 days.

(21) Appl. No.: 09/585,702

(22) Filed: May 31, 2000

(51) Int. Cl.[7] ..... A45D 8/36
(52) U.S. Cl. ..... 132/200; 132/273
(58) Field of Search ..... 132/200, 222, 132/273, 275, 246, 247; 2/171, 209.3, 195.4, DIG. 11

(56) References Cited

U.S. PATENT DOCUMENTS

| | | | | | |
|---|---|---|---|---|---|
| 2,595,657 | A | | 5/1952 | Harmon | 132/46 |
| 3,467,111 | A | | 9/1969 | Benson | 132/46 |
| D254,273 | S | | 2/1980 | Lawrence | D28/41 |
| 4,745,933 | A | | 5/1988 | Saenger | 132/53 |
| 4,819,671 | A | | 4/1989 | Walker | 132/54 |
| 4,834,118 | A | * | 5/1989 | Goeller | 132/211 |
| 5,372,151 | A | | 12/1994 | Kuo | 132/200 |
| 5,458,108 | A | * | 10/1995 | Jacobs | 132/156 |
| 5,713,218 | A | | 2/1998 | McCabe | 63/3.1 |
| 5,771,907 | A | * | 6/1998 | Dickson | 132/247 |
| 5,822,798 | A | | 10/1998 | Baxley | 2/182.6 |
| D402,091 | S | | 12/1998 | Bratcher | D2/894 |
| 5,867,833 | A | * | 2/1999 | LeDonne | 2/171 |
| 5,890,494 | A | * | 4/1999 | Sonstegard | 132/273 |
| 5,893,376 | A | | 4/1999 | Glassberg | 132/273 |
| 6,047,708 | A | | 4/2000 | Panel et al. | |

* cited by examiner

*Primary Examiner*—Todd E. Manahan
*Assistant Examiner*—David Comstock

(57) ABSTRACT

A hair band that is comfortable to wear all day without engaging individual strands of the wearer's hair. The band includes a flexible rod having a substantially arcuate shape having an apex and two ends. The flexible rod is of a length to terminate above the wearer's ears when the flexible rod's apex confronts the apex of the wearer's head. The flexible rod is encased in a padded portion that confronts the wearer's head and cushions the rod from the wearer's head and terminates near the wearer's ears. Two straps, which are preferably padded, extend from and are adhered to the padded portion encasing the flexible rod such that the straps and padded portion form a large arcuate member. Fasteners, such as strips of hook and loop fasteners, are on corresponding portions of the straps to readily attach and detach the straps and form a substantially circular hair band that is worn around the wearer's head with the flexible rod adjacent the wearer's head's apex and and the straps are attached behind the wearer's head below the wearer's hair.

20 Claims, 6 Drawing Sheets

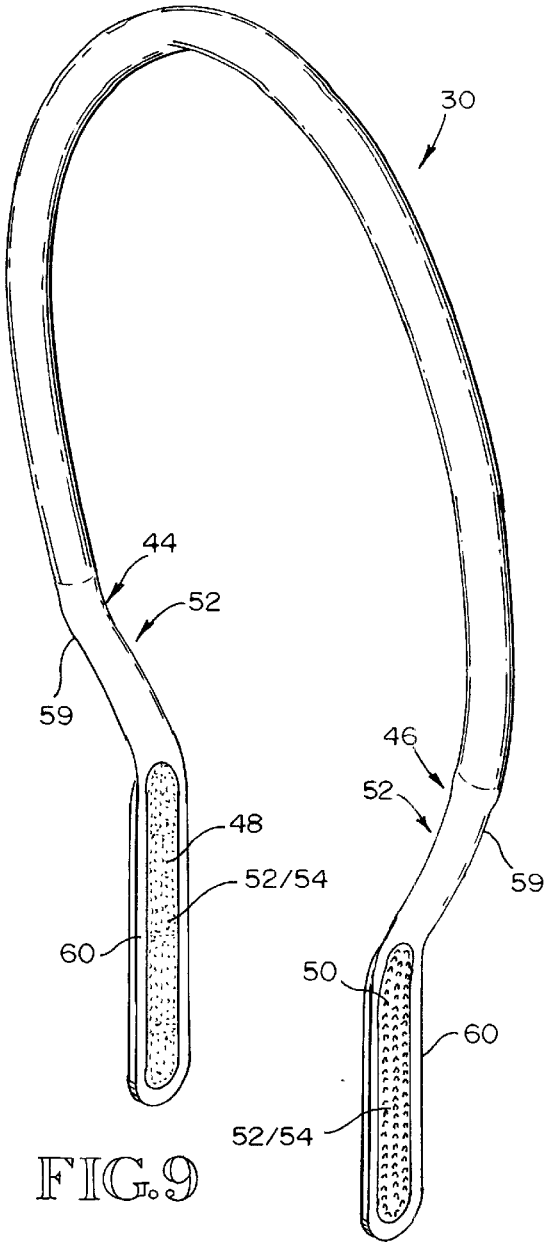
FIG. 9
FIG. 10
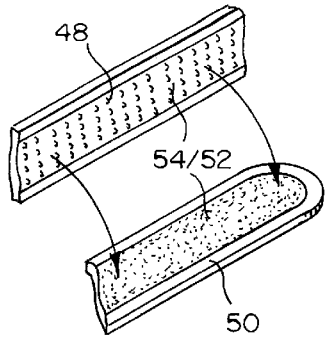
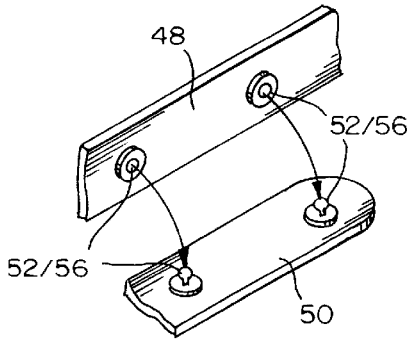
FIG. 11
FIG. 12
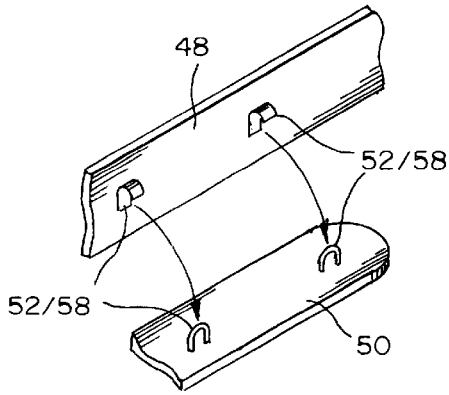

FIG. 15
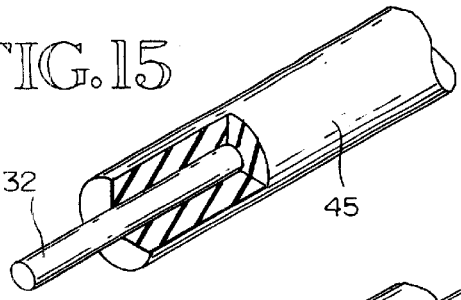
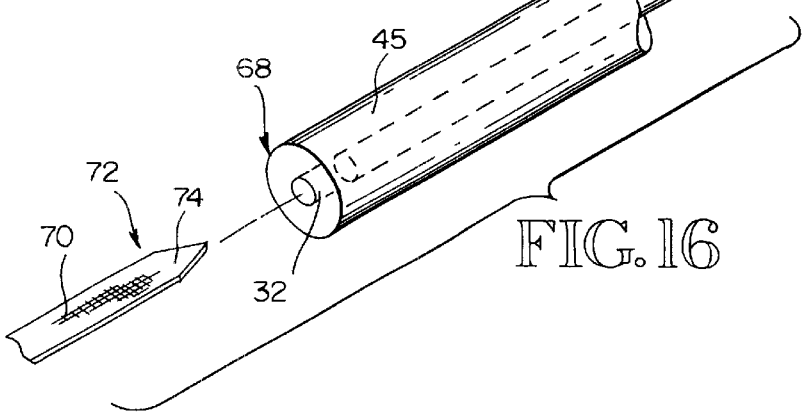
FIG. 16
FIG. 17
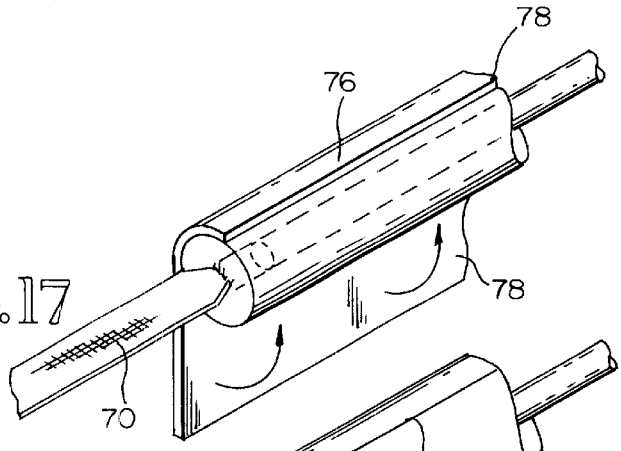
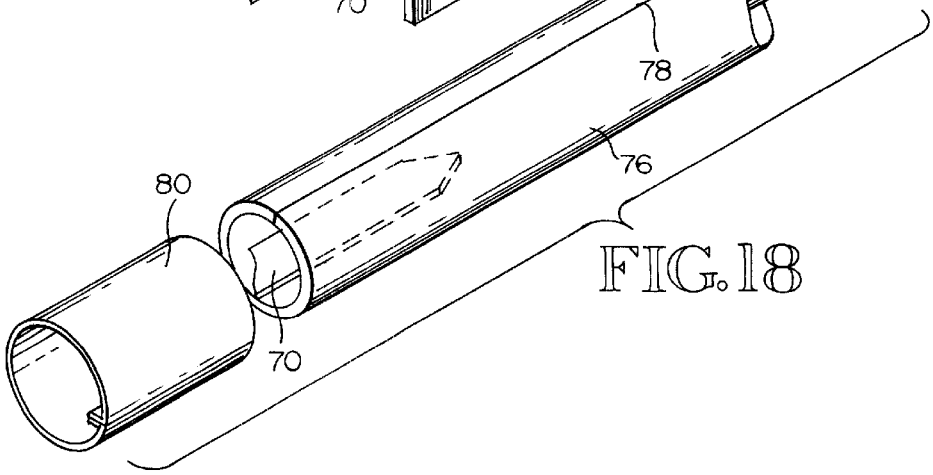
FIG. 18

HAIR BAND HAVING STRAPS AND FLEXIBLE ROD

TECHNICAL FILED

The present invention is generally related to hair bands. More particularly, the invention is related to a flexible and adjustable substantially circular band that maintains hair placement for the wearer without engaging the wearer's individual hairs and minimizes pressure to the wearer's head that leads to headaches.

BACKGROUND OF THE INVENTION

Hair bands, or a band that holds a wearer's hair behind the band and away from the wearer's face and ears, have been used extensively over the years. Typically, such bands are worn by women for function and aesthetics (i.e. hair adornment). Two traditional hair bands are shown at FIGS. 1 and 2. FIG. 1 shows the classic plastic arcuate shaped band 2 with grips 4 (small teeth) to engage the wearer's head 6 and hair 8 (individual hair strands shown at 9). The arcuate band 2 terminates behind the wearer's ears 10 and is held in place by tension. FIG. 2 shows another classic: a one-piece flexible elastic band 12 that expands, similar to a rubber band, to surround the wearer's head and is held in place through tension pressure. Both of these prior art hair bands tend to give the wearer a headache and are often removed prematurely by the wearer. Moreover, tension bands wear out over time and often cannot sufficiently remain in place.

Other hair bands are known, such as Baxley, U.S. Pat. No. 5,822,798, granted Oct. 20, 1998, and entitled "Hair Band." But Baxley teaches gripping individual strands of the wearer's hair through the connection of a multiplicity of hook and loop fasteners, which can get caught and can cause pain to the wearer and/or hair breakage/damage.

An object of the present invention is to provide a comfortable hair band that securely holds the wearer's hair back from the wearer's head and ears, but without engaging individual hair strands of the wearer.

SUMMARY OF THE INVENTION

The present invention is a flexible closable hair band that is designed for comfort for the wearer. The hair band includes a flexible rod having a substantially arcuate shape having an apex and two ends. The rod is of a size to confront a wearer's head such that the apex of the flexible rod substantially confronts the apex of the wearer's head. The two rod ends terminate above the wearer's ears, such that one rod end terminates above thewearer's right ear and the rod's other end terminates above the wearer's left ear. According to one aspect of the invention, the rod is preferably in the range of 10–12 inches in length.

The band further includes a padded portion that encases the flexible rod. The padded portion closely confronts the wearer's head from the wearer's apex in a substantially arcuate path and the two ends terminate near the wearer's ears. The padded portion provides comfort to the wearer.

The band further includes two straps extending from the ends of the padded portion, one strap per padded end portion. Each strap includes a corresponding portion of an attachable/detachable fastener such that the fastener, when mated, joins the two straps together. The resulting band and closed straps form a substantially circular ring.

In use, the wearer positions the arcuate padded portion that encases the flexible rod on the wearer's head by placing the apex of the flexible rod atop the apex of the wearer's head. The straps are in the open position (detached) and positioned adjacent and behind the wearer's ears. The wearer fastens the straps together at the fastener such that the hair band is now in the closed position underneath the wearer's hair without engaging any individual strands of the wearer's hair.

According to one aspect of the invention, the fastener is corresponding strips of hook and loop fasteners. Alternatively, the fasteners may be snaps or hook and eye fasteners, or other well-known fastener means.

According to another aspect of the invention, the strap is an elongated padded portion having a substantially circular cross section at the end that joins the padded portion end and the strap further includes an elongated flattened portion. The flattened padded portion includes the corresponding portion of the fastener. The flattened padded portion is preferably approximately 3 to 3½ inches in length.

According to yet another aspect of the invention, decorative indicia may be added to the hair band.

The invention also includes a method of manufacturing the hair band of the present invention. Beyond providing the flexible rod as discussed above, the rod is encased in tubing having two ends. Two elongated strips of padding, which may be fusible fleece, are rolled into two elongated rolls. The two padding rolls will form the straps of the hair band. One end of each padded roll is inserted and adhered, such as by glue, to one end of the encased rod. The resulting joined padded roll and encased rod is rolled within an elongated sheet of interface having two elongated edges, preferably fusible interface, where the two elongated edges are joined to encase the joined padded roll and encased rod.

A portion of a corresponding fastener to allow for ease in attaching and detaching the one portion of the fastener to the other fastener is added to the dangling ends of the interface-encased roll in order to join the two dangling ends of the interface-encased roll together when the hair band is in use.

For a neater appearance, a fabric sheath may encase the entire interface encased roll, with the fastener portions placed atop of the dangling ends of the fabric-encased roll.

In the fabric-encased roll or the lone interface-encased roll, the dangling ends may be stitched together for a neater appearance.

These and other features and benefits will be discussed in further detail in the various figures of the attached drawing, the Brief Description of the Drawing, and the Best Mode for Carrying Out the Invention.

BRIEF DESCRIPTION OF THE DRAWING

Like reference numerals are used to designate like parts throughout the several views of the drawing, wherein:

FIG. 9 is perspective view of the hair band of the present invention shown in the open position with the straps detached from each other;

FIG. 10 is an enlarged perspective view of the pair of straps of the hair band about to be mated by corresponding hook and loop fasteners;

FIG. 11 is an enlarged perspective view of a first alternate embodiment of corresponding closeable fasteners (snaps) on the straps;

FIG. 12 is another enlarged perspective view of a second alternate embodiment of corresponding fasteners (hooks and eyes) on the straps;

FIG. 15 is a perspective view of a flexible rod encased in a rubber tubing;

FIG. 16 is a perspective view of fusible fleece padding having a tapered end being attached to one of the ends of the tubing;

FIG. 17 is a perspective view of the resulting adhered fusible fleece padding and flexible rod and tubing rolled into fusible interfacing; and FIG. 18 is a perspective view of the resulting fusible interface encased tubing and fleece padding combination inserted into a tubular fabric sleeve.

BEST MODE FOR CARRING OUT THE INVENTION

Figure 1:
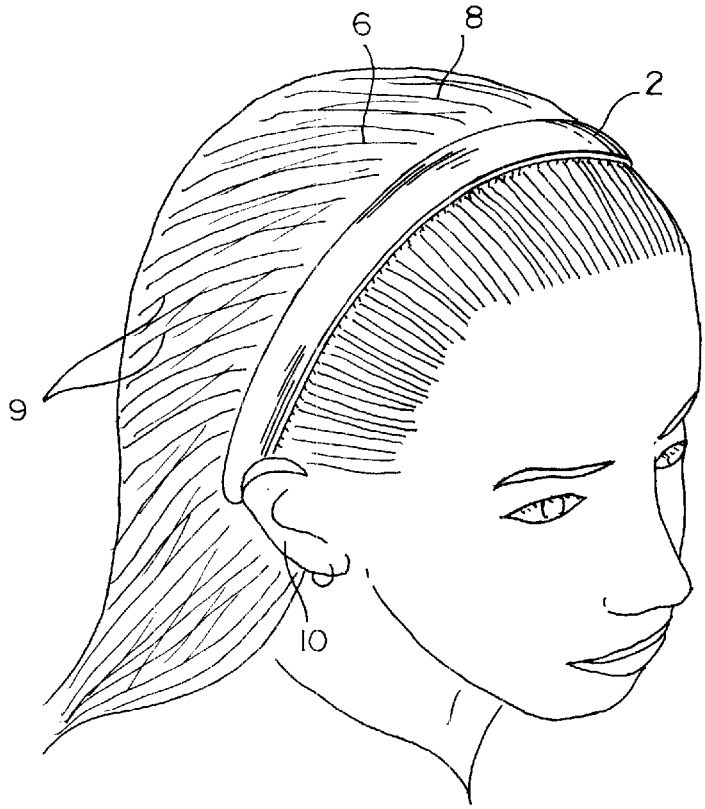
FIG. 1 PRIOR ART
FIG. 1 is a perspective view of an arcuate prior art hair band being worn on a wearer's head and shown gripping hairs through a plurality of tine gripping teeth.
Figure 2:
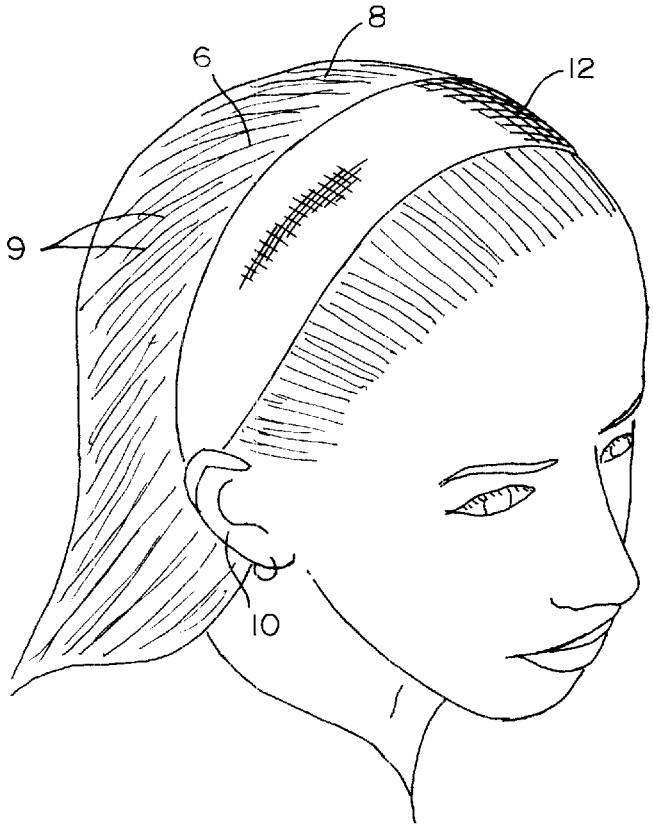
FIG. 2 PRIOR ART
FIG. 2 is a perspective view of a prior art circular elastic hair band that expands and is held in place around the wearer's head through tension.
Figure 3:
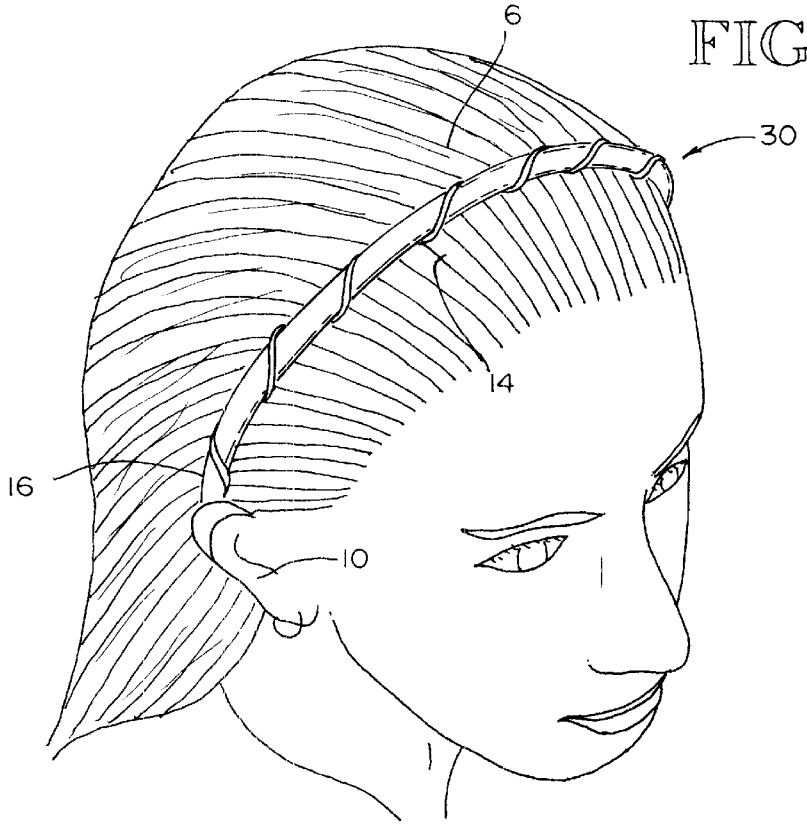
FIG. 3 is a perspective view of the hair band of the present invention being worn on a wearer's head without undue tension holding the band in place and without engaging individual stands of hair.
Figure 4:
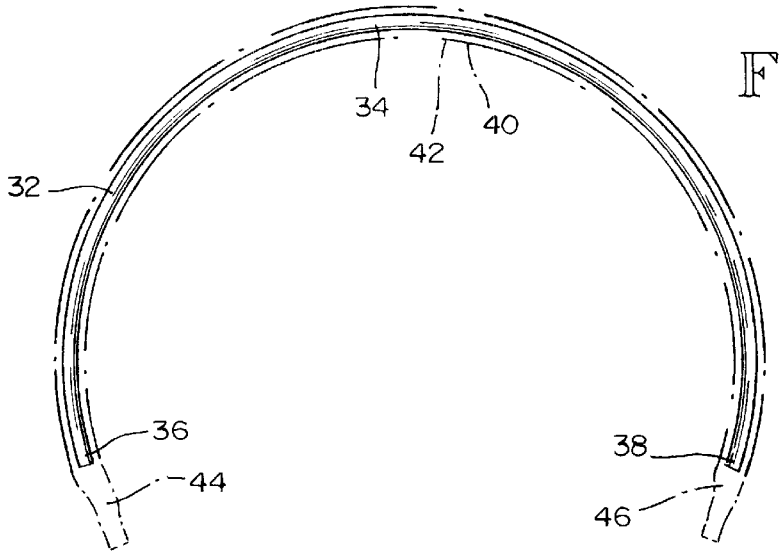
FIG. 4 is a front view of an arcuate flexible rod encased in a padded portion (shown in hidden lines)
Figure 14:
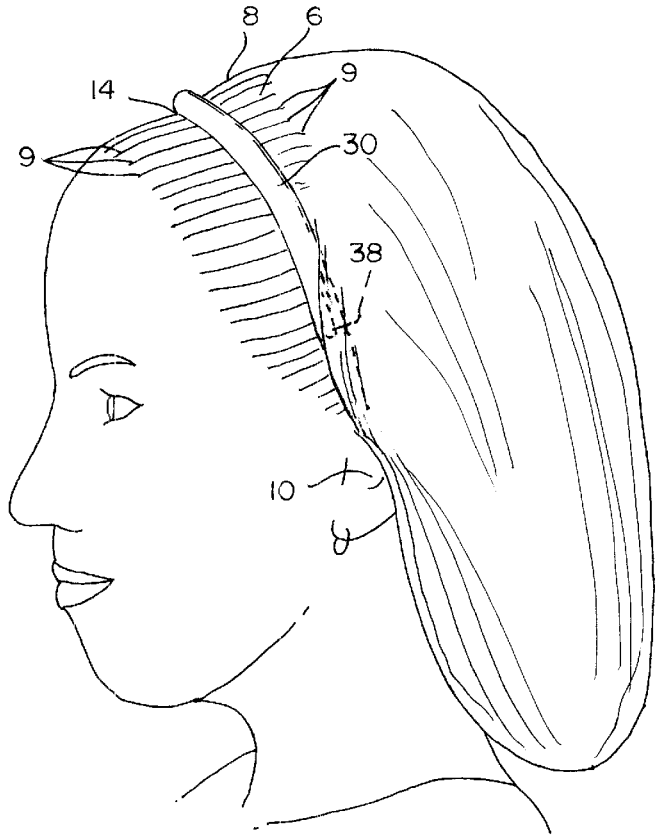
FIG. 14 is a perspective view of the wearer wearing the hair band of the present invention as viewed from the wearer's left side.

Referring to FIGS. 3–4 and 14, the present invention is a hair band 30 having an arcuate shaped flexible rod 32 defining an apex 34 and two ends 36, 38. The flexible rod 32 is of a length to accommodate a wearer's head (shown at 6) such that the apex of the flexible rod 34 is designed to confront the apex 14 of the wearer's head and the two distal ends of the flexible rod 36 and 38 terminate above the wearer's ears 10. Each flexible rod end 36, 38 terminates above a corresponding ear 10.

The flexible rod is of a length to accommodate a wearer's head, which is typically in the range of 10–12 inches. An 11-inch flexible rod has been found to accommodate the majority of women's heads. A 16 gauge galvanized steel wire has proven to give adequate results, although other flexible rods may be used.

The flexible rod 32 is encased in a padded portion 40 having an apex 42 and two ends 44, 46 that also that provides cushioning to the wearer's head. The padded portion terminates near the wearer's ears 10. In preferred form, the padded portion tapers near the wearer's ears to alleviate perceived bulkiness. As will be discussed below, the padded portion 40 is slightly longer than that of the flexible rod 32.

Figure 7:
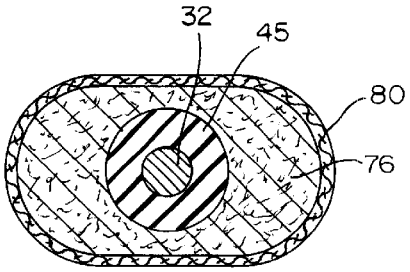
FIG. 7 is a cross section view of a first alternate embodiment of the hair band.
Figure 8:
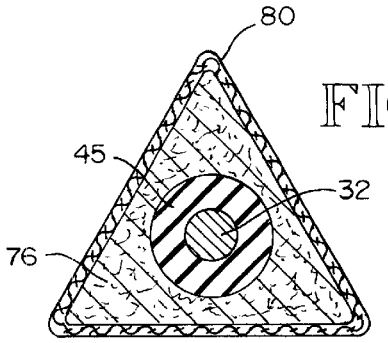
FIG. 8 is a cross section view of a second alternate embodiment of the hair band.

Referring to FIGS. 5–8, the padded portion may include a flexible tubing 45 that covers the flexible rod 32 with further cushioning 47 surrounding the flexible tubing 45. Alternatively, the padded portion may be some form of cushioning that covers the flexible rod (not shown). The padded portion may take on various cross-sectional shapes; although it is envisioned that the circular cross section shape shown in FIG. 6 will be the most popular. Although the alternate cross-sectional shapes shown in FIGS. 7 and 8 show a circular cross section flexible tubing 45 with separate cushion material 47, the tube and cushion material could be one and the same (not shown).

Referring to FIGS. 5, 9–12, a pair of elongated straps 48, 50 are attached to the padded portion 40 at a corresponding end 44, 46. Each strap 48, 50 includes a portion of a fastener 52 that mates with its corresponding portion of the fastener to secure a portion of strap 48 to a portion of strap 50. The fastener is of a type that allows attachment and detachment of the one strap 48 to the other padded strap 50. Although the preferred fastener is two corresponding strips of hook and loop fasteners 54, such as the kind sold under the trademark VELCRO, (FIGS. 9 and 10), other well-known mechanical fasteners such as snaps 56 (FIG. 11) and hook and eye fasteners 58 (FIG. 12) may be used.

Figure 5:
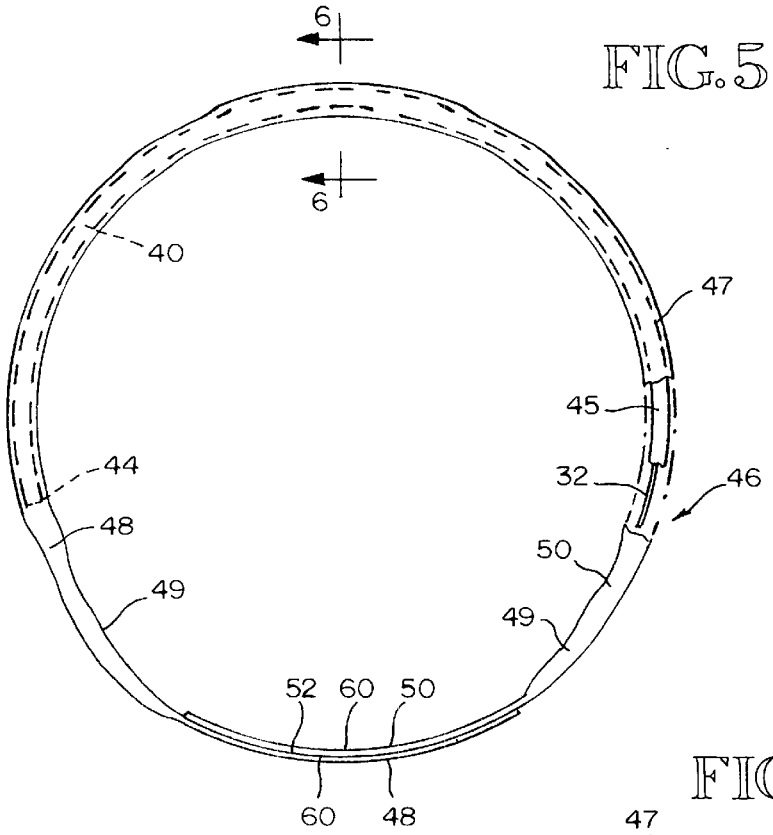
FIG. 5 is a front view of the hair band showing the padded portion in hidden lines and a portion of the padded portion and the flexible rod shown in cutaway; further the front view showing a pair of straps, with one strap extending from each end of the padded portion and with the straps shown attached to form a circular hair band of the present invention.
Figure 6:
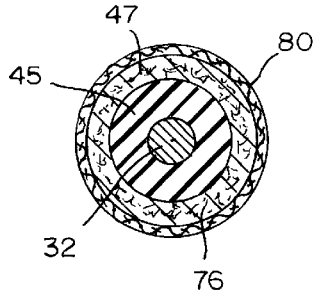
FIG. 6 is a cross section view of the hair band taken substantially along lines 6—6 of FIG. 5.

Referring particularly to FIGS. 5 and 9, each strap 48, 50 is preferably padded and includes an upper proximal portion 59 that may include a substantially circular cross section where the proximal end 52 of the proximal portion is connected to a corresponding padded portion ends 44, 46. The strap then tapers, shown at component 49, and flattens out to a padded portion 60 of approximately 3 to 3½ inches. The fastener is connected to the padded portion 60. Padding, or cushioning, in the straps and the flattened shape makes the band more comfortable to the wearer.

Figure 13:
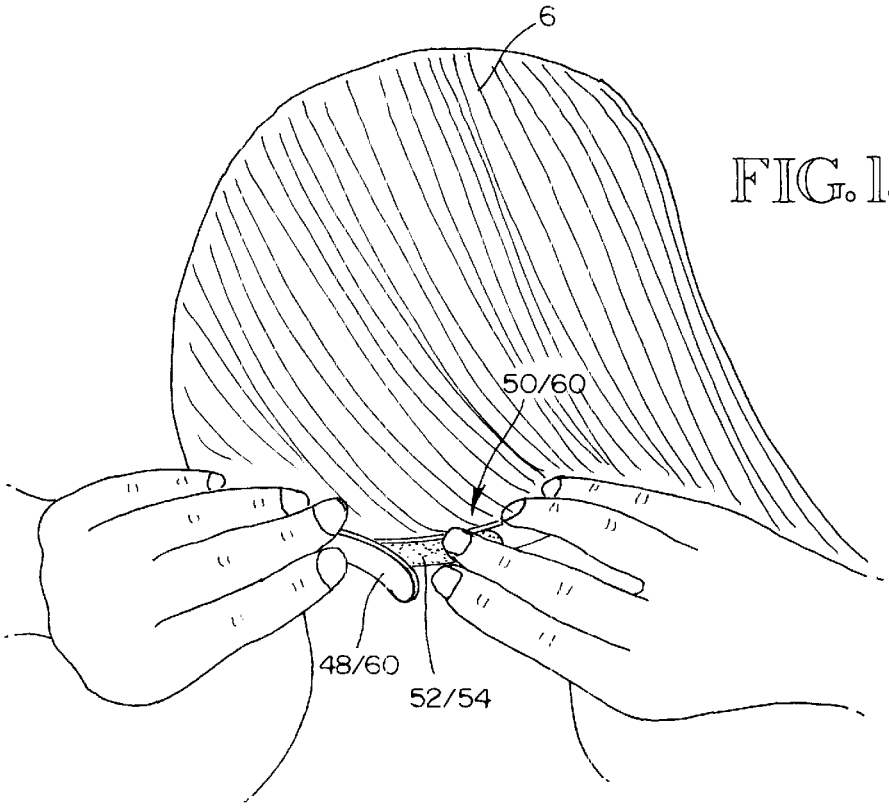
FIG. 13 is a perspective view of the back of the wearer's head and with the wearer shown closing the straps to secure the hair band underneath the wearer's hair and adjacent and behind the wearer's ears.

Referring to FIGS. 3, 5, and 13–14, in use, the padded portions 60 of straps 48, 50 mate via the fastener 52 to form a substantially circular ring 62 as shown in FIG. 5. The mated padded straps overlap each other approximately 3 to 3½ inches as shown in FIG. 13 to sufficiently connect strap 48/60 to strap 50/60 such that the band will not come prematurely undone.

As shown in FIG. 14, the hair band when worn is positioned behind the wearer's ears 10 with the wearer's hair positioned over the attached straps. But unlike much of the prior art, the wearer's hair 8 is not gripped or individual hair strands 9 are not "captured" by the hair band. The hair band is securely held adjacent the head, but with little tension. The padding of the hair band that confronts the wearer's head provides additional comfort. Thus, the wearer can wear the hair band of the present invention all day long without the need for premature removal due to tension headaches.

The hair band of the present invention may also include decorative indicia. Any color or design may be incorporated into the band by including a desired fabric sheath over the padded portion and straps. Decorative design features, such as a spiral may be externally added, such as that shown in FIG. 3 or in my co-pending design patent applications filed May 31, 2000 and entitled "Hair Band" may added.

Referring to FIGS. 15–18, the invention further includes a method of manufacturing the hair band of the present invention. One step is to provide a flexible rod, which may be a 16 gauge galvanized steel wire 32 approximately 10–12 inches long, as described above. A flexible tubing 45, such as 7–64-inch windshield hose, is cut a little longer than that of the flexible rod. The tubing ends 68 may be straight or tapered ¾ inch (not shown). That rod 32 is inserted into the flexible tubing 45. If sticking is anticipated, cornstarch may be added into the flexible tubing 45 prior to inserting the rod 32. This is shown in FIG. 15.

The straps may be formed of fusible fleece 70. Each strap may be made into a ½ inch by 3½ inch–6½ inches strip. Of course, the length of the strap will be ultimately determined by the desired length of the resulting hair band. Referring to FIG. 16, the proximal end 72 of each fusible fleece strap 70 is tapered to a point 74. Each tapered point of each strap is inserted approximately ⅜ inch into the tube end 68 (either straight or tapered) and adhered to the resulting tube end 68 of the flexible tubing and rod combination. Any adhesive that will securely adhere the tapered point 74 and fleece strap to the tubular end 68 is preferable, although craft glue has been found to work sufficiently.

Next, the resulting tubular member encased rod and the adhered fusible fleece strapsare rolled in fusible interfacing 76 of approximate 1½ inches by 28 inches long. This is partially shown in FIG. 17, which for clarity only shows a portion of the fusible interfacing. Iron-on adhesive may be used to adhere the two lengthwise edges 78 of the interfacing together to form a resulting tubular member encased in the interfacing. The ends would be stitched or otherwise closed for a neater appearance.

A desired material finish may be made into a tubular sheath 80 to encase the already tubular interfaced flexible rod, tubing, and fleece straps, as shown in FIG. 18.

Last, the fasteners 52 (such as the hook and loop fasteners) are attached to the strap ends. Any labeling and /or decorative indicia may be added, if desired.

The illustrated embodiments are only examples of the present invention and, therefore, are non-limitive. It is to be understood that many changes in the particular structure, materials, and features of the invention may be made without departing from the spirit and scope of the invention. Therefore, it is the applicant's intention that her patent rights not be limited by the particular embodiments illustrated and described herein, but rather by the following claims interpreted according to accepted doctrines of claim interpretation, including the doctrine of equivalents and reversal of parts.

What is claimed is:

1. A flexible hair band to be worn on a wearer's head comprising:

flexible rod having a substantially arcuate shape having an apex and two ends, said rod being of a size to conform to the wearer's head such that the apex of the flexible rod substantially conforms to the wearer's head's apex and the two ends terminating above the wearer's ears with one end of the rod terminating above the wearer's right ear and the other end terminating above the wearer's left ear;

a padded portion encasing the flexible rod such that the padded portion closely confronts the wearer's head from the apex in a substantially arcuate path terminating near both the wearer's ears;

two straps extending from the padded portion where the flexible rod's two ends terminate, such that one strap extends from the padded portion that encases the one flexible rod end and the other strap extends from the padded portion that encases the other flexible rod end distance from said strap ends;

said two straps, each said strap further including an external corresponding attachable and detachable mating fastener such that when the two straps are fastened together at the corresponding fastener the padded arcuate flexible rod and mated straps form a closed substantially circular ring;

wherein in use the wearer positions the arcuate padded portion that encases the flexible rod on the wearer's head by placing the apex of the flexible rod atop the apex of the wearer's head with the open straps adjacent and behind the wearer's ears with one strap adjacent and behind its corresponding ear, and wherein the straps are positioned and attached at the respective corresponding fasteners underneath the wearer's hair to maintain placement of the wearer's hair positioned behind the arcuate portion of the hair band an above the attached straps without engaging any individual strands of the wearer's hair.

2. The hair band according to claim 1, wherein the fasteners on each on each strap is a strip of corresponding hook and loop fasteners.

3. The hair band according to claim 1, wherein the fastener on each strap is at least one corresponding snap.

4. The hair band according to claim 1, wherein the fastener on each strap is a portion of at least one mateable hook and eye fastener.

5. The hair band according to claim 1, wherein the shape of each strap is substantially elongated and flat where the fastener is positioned.

6. The hair band according to claim 5, wherein the fastener on each strap is a strip of corresponding hook and loop fasteners.

7. The hair band according to claim 5, wherein the shape of the padded portion encasing the flexible rod has a substantially circular-shaped cross section.

8. The hair band according to claim 7, wherein the fastener on each strap is a strip of corresponding hook and loop fasteners.

9. The hair band according to claim 5, wherein the substantially elongated and flat portions of each strap are padded and overlap each other approximately 3 to 3½ inches when fastened.

10. The hair band according to claim 9, wherein the fastener on each strap is a strip of corresponding hook and loop fasteners.

11. The hair band according to claim 1, wherein the shape of the padded portion encasing the flexible rod has a substantially circular-shaped cross section.

12. The hair band according to claim 1, wherein decorative indicia is externally positioned on the padded position to be visible to others when the wearer is wearing the hair band.

13. The hair band according to claim 1, wherein the flexible rod is in the range of 10 to 12 inches.

14. A method of making a flexible hair band comprising the steps of:

a) providing a flexible rod of approximately 10 to 12 inches in length;

b) encasing the flexible rod in a tubing having two ends, said tubing being of a length slightly longer than that of the flexible rod;

c) providing two elongated strips of padding;

d) rolling the two elongated strips of padding and adhering one end of each rolled elongated strip to a corresponding end of the tubing;

e) providing a sheet of elongated interface having two elongated edges;

f) rolling the resulting rolled elongated and adhered strip of padding within the interface and joining the two elongated edges of the interface around the resulting rolled elongated and adhered strip of padding to form a seam and encase the resulting rolled elongated and adhered strip of padding; and g) adding a corresponding attachable and detachable mating fastener externally to the encased resulting rolled elongated and adhered strip of padding at an end portion of the encased interface, forming two straps having corresponding portions of the fastener such that when the two straps are fastened together at the fastener, the rolled elongated and adhered strip of padding forms a closed substantially circular ring.

15. The method according to claim 14, wherein the tubing is a windshield tube.

16. The method according to claim 14, wherein the method further includes the step of providing a fabric sheath that encases the rolled elongated and adhered strip of padding prior to adding the external corresponding fastener portions.

17. The method according to claim 14, wherein the padding is fusible fleece.

18. The method according to claim 14, wherein the padding is tapered at the end that is adhered to an end of the tubing.

19. The method according to claim 14, wherein the end of the padding is glued to an end of the tubing.

20. The method according to claim 14, wherein the interface is fusible.

* * * * *

UNITED STATES PATENT AND TRADEMARK OFFICE

CERTIFICATE OF CORRECTION

PATENT NO. : 6,470,896 B1
DATED : October 29, 2002
INVENTOR(S) : Mensonides

It is certified that error appears in the above-identified patent and that said Letters Patent is hereby corrected as shown below:

Title page, Item [54] and Column 1, lines 1 and 2,
Title of the invention, should be -- FLEXIBLE HAIR BAND --.

Title page,
Insert -- [74] *Attorney, Agent, or Firm*– Kathleen T. Petrich

Column 1,
Line 5, please substitute "FIELD" in place of -- FILED --.
Line 50, insert space between "the" and "wearer's".

Column 3,
Line 44, please substitute "Carrying" for -- Carring --;

Column 5,
Line 19, please insert a space between "straps" and "are".
Line 61, add after "terminate", -- each strap having an end --,
Line 64, add after "end", -- and said rod ends terminate a substantial --.

Column 6,
Line 15, substitute -- and -- for "an".
Line 19, substitute -- fastener -- for "fasteners".

Signed and Sealed this

Twelfth Day of August, 2003

JAMES E. ROGAN
*Director of the United States Patent and Trademark Office*